United States Patent [19]

Botzem et al.

[11] Patent Number: 4,625,122

[45] Date of Patent: Nov. 25, 1986

[54] DEVICE FOR THE HANDLING AND PROTECTION OF CANISTERS FOR STORING RADIOACTIVE MATERIALS

[75] Inventors: Werner Botzem, Alzenau; Heinrich Quillmann, Nidderau, both of Fed. Rep. of Germany

[73] Assignee: NUKEM GmbH, Hanau, Fed. Rep. of Germany

[21] Appl. No.: 621,290

[22] Filed: Jun. 15, 1984

[30] Foreign Application Priority Data

Jun. 24, 1983 [DE] Fed. Rep. of Germany ..... 3322770

[51] Int. Cl.[4] ..... G21F 5/00

[52] U.S. Cl. ..... 250/506.1

[58] Field of Search ..... 250/506.1, 507.1; 252/633

[56] References Cited

U.S. PATENT DOCUMENTS 4,366,095 12/1982 Takats et al. ..... 250/506.1

FOREIGN PATENT DOCUMENTS 2091477A 7/1982 United Kingdom ..... 252/633

*Primary Examiner*—Alfred E. Smith
*Assistant Examiner*—Jack I. Berman
*Attorney, Agent, or Firm*—Beveridge, DeGrandi & Weilacher

[57] ABSTRACT

A device for the handling and protection of canisters for storing radioactive materials is described, which are encapsulated by a shock sensitive corrosion resistant cladding hull. The lower and upper edge areas of the canisters are covered by guard caps which are held in place during handling by lifting bars connected to a lifting plate.

14 Claims, 3 Drawing Figures

DEVICE FOR THE HANDLING AND PROTECTION OF CANISTERS FOR STORING RADIOACTIVE MATERIALS

The subject of the invention is a device for the handling and protection of a canister for storing radioactive materials provided with a shock sensitive corrosion resistant cladding hull, more particularly a shock sensitive ultimate disposal container sealed by a cover for containment and isolation in geologic formations.

Radioactive materials, e.g., radioactive wastes from the reprocessing of nuclear fuel assemblies, after conditioning, are first placed in transit storage, then stored in suitable geologic formations, isolated from the biosphere. The radioactive materials, which are customarily solids, are packaged in round or angular canisters, e.g., in sealed containers or in monolithic compacts in which the radioactive materials are embedded or encased. The canisters must be able to withstand corrosion for the long term. Therefore, metal containers are often provided with a corrosion protective resistant layer made of a nonmetallic material, e.g., ceramics. Some containers consist entirely or chiefly of ceramic material, such as aluminum oxide. Also, monolithic compacts made of graphite are provided for the final waste disposal. The protective corrosion resistant protective layers employed, but above all the nonmetallic protective corrosion resistant material, are extremely sensitive to shocks and must be protected against damage in transit and against orogenic disturbances during containment. This applies in particular to the exposed marginal edge areas of the containers. Moreover, along with possible damage as a result of handling during transport and when introducing the waste material into the disposition facilities, e.g., when storing it in boreholes in salt formations, damage to the corrosion resistant protective layer in the first few years of containment cannot be ruled out since, especially in the initial period following the establishment of the disposition facilities, certain orogenic activities might still occur at the repository site before any such geologic disturbances subside.

Therefore, some thought has been given in the past to the concept of placing containers with nonmetallic corrosion resistant protective layers and nonmetallic compacts in metal supercontainers which, in turn, are provided with lifting lugs or other devices for handling by means of hoisting devices or manipulators. However, such protective equipment has the disadvantage that any shearing forces occurring are transmitted over a small area to the underlying corrosion protective layer, unless the wall of the metal supercontainer is very thick. But this would increase the weight of the canister, which already weighs several metric tons. It would make handling more difficult, would limit the storage capacity, and would substantially increase the costs of the canister as well as the containment itself.

Therefore, the major object of the invention is to create a device for the handling and protection of a canister for storing radioactive materials having a shock sensitive ultimate storage container sealed by a cover for disposition in boreholes in geologic formations. This device effectively protects the highly shock sensitive marginal edge areas. Moreover, it is easy to handle, makes optimal use of the existing storage capacity, is of simple construction and light in weight, and is inexpensive to manufacture.

According to the invention, this object is achieved by encasing the lower edge area of the canister with a bottom edge guard cap and its upper edge area with a top edge guard cap, said guard caps being releasably contained together by means of lifting bars via a lifting plate provided with supporting means for a hoisting device, the lifting bars having on their respective remote top ends operational devices for the locking and releasing of the lifting bars with respect to the bottom end cap.

When using ultimate disposal containers, the height of the protective barrier of the top edge guard cap is preferably greater than the thickness of the cover of the ultimate disposal container, so that further protection is provided for the sealing area between container body and cover.

Experiments have shown that it is an advantage to pass the lifting bars through recesses or holes arranged axially in the protective barrier of the top edge guard cap and to screw them into the guard wall of the bottom edge guard cap. In this way it is possible to reduce the diameter of the device, to improve the efficiency of the storage volume and to minimize the dimensions of the borehole.

Furthermore it is advantageous to have energy dissipating elements in the form of shock absorbers on the top edge guard cap and/or the bottom edge guard cap.

In this way, in the event a canister should be put down hard on another canister in a subterranean cavity or in a borehole, this will not produce deleterious effects even with rough handling.

To further protect the edges of the canisters, it is also advantageous to provide the bottom edge guard cap and the top edge guard cap on the inside, at the vertex of the angle included between the particular protective barrier and the particular bottom, with a circumferential hollow groove.

The device incorporating the invention will be described in greater detail in conjunction with the schematic FIGS. 1 to 3 given solely by way of illustrative example. In the drawings.

Figure 1:
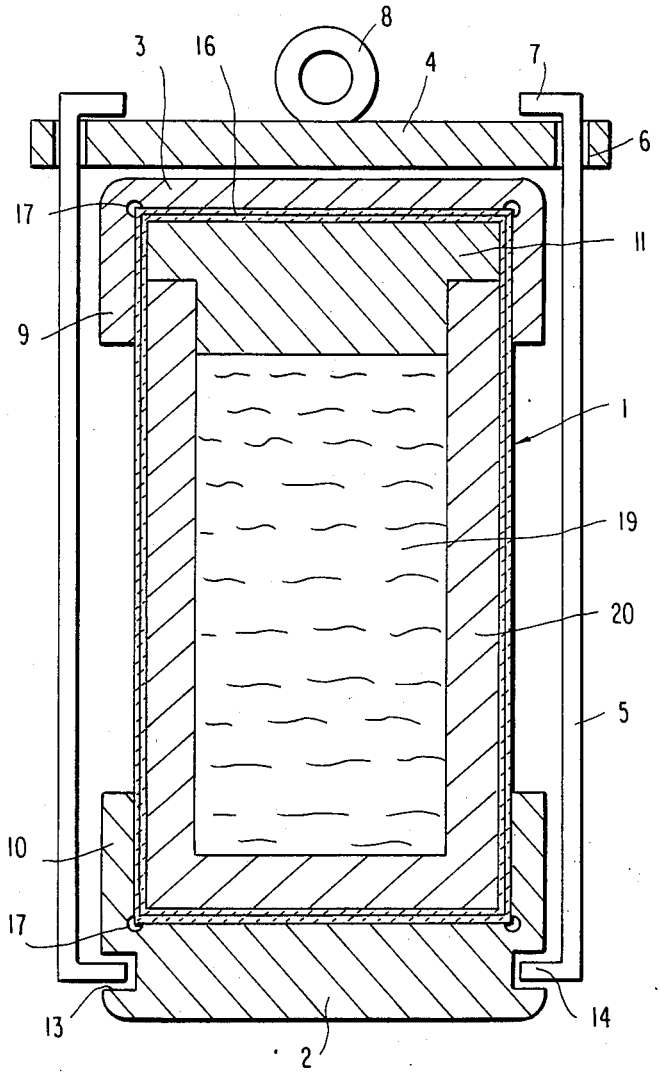
FIG. 1 is a longitudinal cross sectional view of a device of the invention.

With regard to FIG. 1, the round or angular (polygonal) canisters (1) are provided according to the invention with a shock sensitive corrosion resistant cladding hull (16). The canisters (1) are designed as containers with side walls (20) and a cover (11) or as graphite blocks and contain radioactive material (19). In many cases, they weigh about 10 to 12 metric tons. The corrosion resistant cladding hull (16) which form the outside of the canister in FIG. 1 can be formed of known ceramic material, the composition of which is not critical. It may also be an enameled metallic surface, as is known in the art. The ceramic material may also be coated on a metallic substrate by flame spraying. In that case, the cladding (16) is formed of two layers. Cover (11) can be formed of various materials such as tempered, high strength steel, as for example, molybdenum nickel steel. Side walls (20) are generally formed of the same material as cover (11). The cover can be screwed into the container. The upper end of the canister (1) is encased by a top edge guard cap (3) which covers the entire upper top of canister (1) and extends downwardly over the top to encase and snugly fit over the upper end of the canister. This term also applies to canisters that do not have an actual cover, but are composed of a material that is compressed on all sides. The lower area of the canister is sealed of or encased by a bottom edge guard cap (2) which also covers the entire bottom surface of the canister and extends around the lower end and fits snugly to the canister bottom. The top edge guard cap (3) and the bottom edge guard cap (2) can be made from inexpensive metallic material, such as steel, or can also be formed of suitable plastic. The plastic material should, of course, be shock resistant. Both can be reverse drawn on, or fitted or fastened to, the canister (1), e.g., by adhesive bonding. As shown in FIG. 1, the edge guard caps (2) and (3) are retained in place by the lifting plate (4) and the lifting bars (5). The lifting plate (4) may be formed of any suitable material such as metal, plastic or wood. The lifting bars (5) are generally metallic of sufficient strength and are shaped at the bottom (14) to fit into the recess in the bottom cap and serve to enable the lifting of the container by lug (8.) At the remote upper end (7), a lever or other suitable means permits the rotation of the lifting bars to disengage the lower portion thereof (14) from the recess in the bottom end cap.

Figure 2:
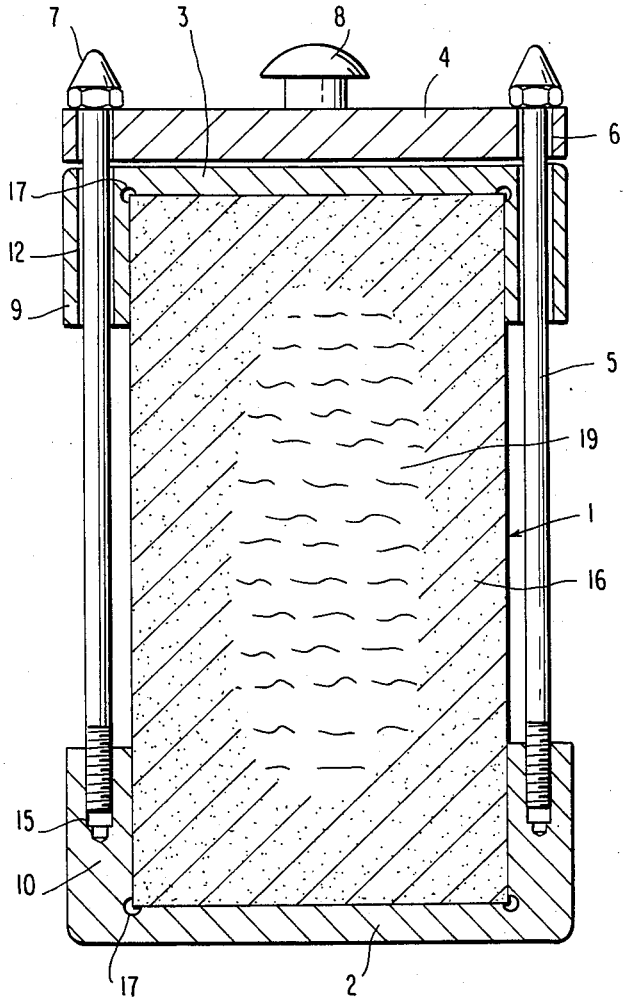
FIG. 2 is a longitudinal cross sectional view of a specific embodiment of the device.

The bottom edge guard cap (2) and the top edge guard cap (3) can be releasably connected to each other by metal lifting bars (5) via a lifting plate (4) as shown in FIG. 2. In FIG. 2, the corrosion resistant cladding (16) is formed of graphite and encases the radioactive solids (19) and therefore no discrete border or boundary exists between the cladding (16) and the radioactive waste (19). The diameter of the lifting bar(s) can be, for example, 2 cm. This dimension can be varied as will be apparent to those skilled in the art. The number of lifting bars (5) is dependent on the geometry of the canister (1). The bars can be round of multi sided in cross section. In the case of a canister with a cylindrical geometry, the use of three lifting bars is advisable. This number can also be varied but should be at least 2. The lifting bars (5) have on their lower end a bend (14) which, during handling of the canister (1), engaged in recesses (13), in the bottom edge guard cap (2). The upper portion of the lifting bars (5) extends through holes (6) in the lifting plate (4) and has, at the top end, remotely operated elements (7); e.g., levers, for rotating the lower ends of the bar out of engagement with the recesses in the bottom end caps. The lifting plate (4) has supporting means (8), e.g., a lug for a crane hook (FIG. 1) or a dome shaped gripping element (FIG. 2).

After lowering the canister (1) into the borehole or other storage location, the lifting bars (5) are disengaged from the recesses (13) by rotating or unscrewing the elements (7), so that the lifting plate (4) with the lifting bars (5) can be used for the canisters following next in succession, the ultimate disposal containers, or compacts, while the edge guard caps (2, 3) remain on the stored canister (1) to ensure protection of the highly sensitive edges, even after handling during ground or strata movements.

The height of the protective barriers (9, 10) of the edge guard caps (2, 3) is so selected that the peripheral areas of the canister (1) near the edges, likewise exposed to geological disturbances, are also protected. Advantageously, the height of the protective barrier (9) of the cover edge guard cap (3) is made greater than the thickness of the cover (11) in case the canister (1) is an ultimate disposal container sealed off by a cover. Thus, the sealing material between container cover (11) and container body (20) is covered over and, hence, protected.

Figure 3:
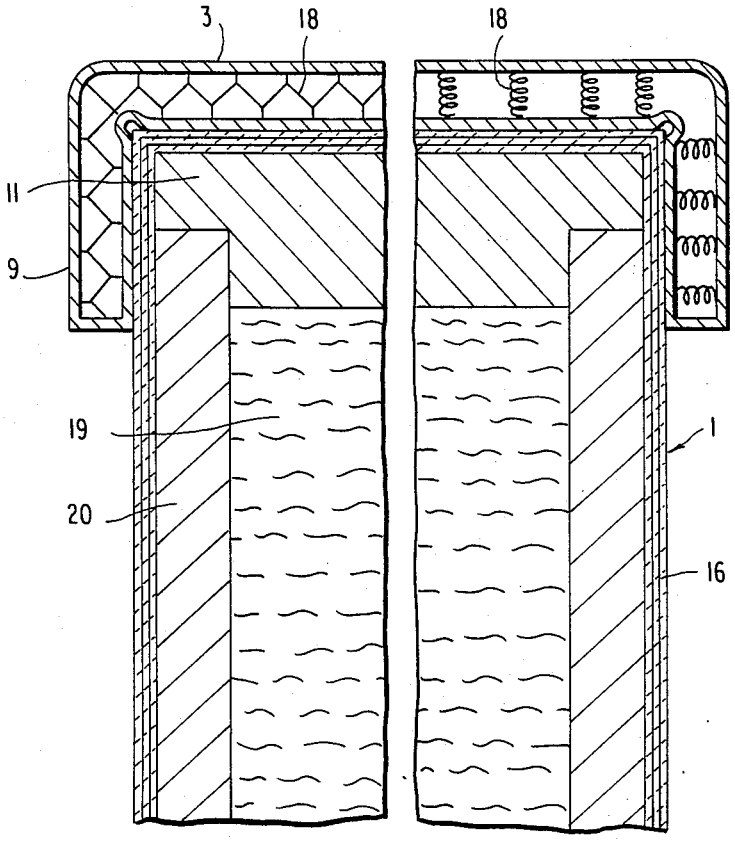
FIG. 3 is a longitudinal cross sectional view of a specific embodiment of the cover edge guard cap.

Since usually a number of canisters (1) are superimposed upon each other, it is of advantage to provide either or both of the bottom edge guard cap (2) and the top edge guard cap (3) with energy dissipating elements in the form of shock absorbers (18), e.g., a honeycomb structure, spring elements, or an insulating material as shown in FIG. 3. In this way, even if a canister is carelessly put down hard, one can prevent the sensitive corrosion resistant cladding or the graphite matrix of a corresponding compressed canister from being subjected to a severe load. Unlike large volume transport shock absorbers for transport containers often weighing over 100 metric tons, which are elaborately designed for drops from great heights in accidental situations, it suffices in the present case to have just a slight damping effect, which only slightly increases the thickness of the edge guard caps (2, 3). The edge guard caps (2, 3) themselves are normally only 2 to 5 cm.

As shown in FIG. 2, advantageously, the lifting bars (5) can be passed through recesses or holes (12) arranged axially in the protective barrier (9) of the top edge guard cap (3) and screwed into the protective barrier (10) of the bottom edge guard cap (2) in corresponding threaded holes (15). Since in this case it is also possible to reduce the diameter of the lifting plate, the borehole (or, in other cases, the stacking geometry) can be made smaller.

Another advantage resides in providing the bottom edge guard cap (2) and the top edge guard cap (3) on the inside, at the vertex of the angle included between the particular protective barrier (9, 10) and the particular bottom, with a circumferential hollow groove (17). As a result, the exposed an endangered edges of the corrosion resistant cladding hull are protected in the edge guard caps (2, 3). Normally, the angle is about 90 degrees. However, it may also be slightly larger, that is, the shape of the edge guard cap may be slightly conical on the inside.

The device embodying the invention not only provides an effective protection of the shock sensitive corrosion resistant protective material of the canister against mechanical damage, such as cracks, spalls and edge chippings, it is also simple and safe to handle. This is a great advantage in view of the radioactive contents of the canisters. Furthermore, the device is easy to manufacture. The edge guard caps may be composed of inexpensive material. The lifting bars (5) are securely held in the bottom edge guard cap (2), but other types of engagement may also be contemplated. The storage capacity in subterranean cavities or boreholes in rock or salt formations is fully utilized. The canister itself can be given a lightweight construction, provided appropriate steps are taken to protect the environment against radiation hazards incidential to the transport and disposal of the radioactive waste material.

Further variations of the device set forth herein will be apparent to persons having ordinary skill in the art and such variations are intended to be included within the scope of the claims appended hereto.

We claim:

1. A device for the handling and protection of a canister for storing radioactive materials comprising a bottom edge guard cap (2) and a top edge guard cap (3), said bottom edge guard cap and top edge guard cap encasing the respective bottom and top edge of said canister to thereby protect the top edge and the bottom edge from damage and to prevent breakage of the canister and leakage of the contents from the canister, said bottom edge guard cap being retained by at least two elongated lifting bars (5) having a top end and a lower end, said lower end being adapted to engage with said bottom edge guard cap, the bottom edge guard cap having a recess formed in the side walls thereof to receive the lower end of said elongated lifting bar, said lifting bars being fitted into a lifting plate (4) which is positioned over and above the top edge guard cap and separated therefrom, said lifting plate (4) being provided with supporting means (8) for hoisting device, said lifting bars having at their top ends means (7) for the locking and releasing of said lifting bars with said bottom edge cap.

2. The device as set forth in claim 1, further comprising providing the protective barrier (9) of the top edge guard cap (3) with a height that is greater than the thickness of the cover (11) of the ultimate disposal container (1) with which it is to be associated.

3. The device as set forth in claim 1, further comprising providing recesses or holes (12) arranged axially in the protective barrier (9) of the top edge guard cap (3) to enable lifting bars (5) to pass through and to be screwed into the protective barrier (10) of the bottom edge guard cap (2).

4. The device as set forth in claim 1, further comprising providing the bottom edge guard cap (2) with a shock absorber (18).

5. The device as set forth in claim 1, further comprising providing the cover edge guard cap (3) with a shock absorber (18).

6. The device as set forth in claim 1, further comprising providing both the bottom edge guard cap (2) and the cover edge cap (3) with a shock absorber (18).

7. The device as set forth in claim 1, further comprising providing the bottom edge guard cap (2) and the top edge guard cap (3) with a peripheral hollow groove (17) on the inside at the vertex of the angle formed between the adjacent inside surfaces of the guard caps.

8. A device for the handling and protection of a canister for storing radioactive materials according to claim 1, further comprising a corrosion resistant ultimate disposal container sealed by a cover for final disposition, which container has its lower edge area fitted with said bottom edge guard cap (2) and its upper edge area fitted by said guard cap (3), said guard caps being releasably retained together by at least two elongated lifting bars (5) having a top end and a lower end, said lower end being adapted to engaged with said bottom edge guard cap, said lifting bar being fitted into a lifting plate (4) with supporting means (8) for a hoisting device, said lifting bars (5) having, at their top ends, means (7) for the locking and releasing of said lifting bars (5) with said bottom edge guard cap.

9. The device as set forth in claim 8, further comprising providing the protective barrier (9) of the top edge guard cap (3) with a height that is greater than the thickness of the cover (11) of the ultimate disposal container (1).

10. The device as set forth in claim 8, further comprising providing recesses or holes (12) arranged axially in the protective barrier (9) of the top edge guard cap (3) to enable said lifting bar (5) to pass through said bar being releasably connected to the protective barrier (10) of the bottom guard cap (2).

11. The device as set forth in claim 8, further comprising providing the bottom edge guard cap (2) with a shock absorber (18).

12. The device as set forth in claim 8, further comprising providing the cover edge guard cap (3) with a shock absorber (18).

13. The device as set forth in claim 8, further comprising providing both the bottom edge guard cap (2) and the cover edge guard cap (3) with a shock absorber (18).

14. The device as set forth in claim 8, further comprising providing the bottom edge guard cap (2) and the top edge guard cap (3) with a peripheral hollow groove (17) on the inside at the vertex of the angle formed between the adjacent interior surfaces of the guard caps.

* * * * *